US006931853B2

(12) United States Patent
Dawson

(10) Patent No.: US 6,931,853 B2
(45) Date of Patent: Aug. 23, 2005

(54) GAS TURBINE COMBUSTOR HAVING STAGED BURNERS WITH DISSIMILAR MIXING PASSAGE GEOMETRIES

(75) Inventor: Robert W. Dawson, Oviedo, FL (US)

(73) Assignee: Siemens Westinghouse Power Corporation, Orlando, FL (US)

( * ) Notice: Subject to any disclaimer, the term of this patent is extended or adjusted under 35 U.S.C. 154(b) by 17 days.

(21) Appl. No.: 10/299,354

(22) Filed: Nov. 19, 2002

(65) Prior Publication Data

US 2004/0093851 A1 May 20, 2004

(51) Int. Cl.[7] ..... F02C 7/228

(52) U.S. Cl. ..... 60/725; 60/737; 60/747; 60/748; 431/114

(58) Field of Search ..... 60/725, 737, 746, 60/747, 740; 431/114

(56) References Cited

U.S. PATENT DOCUMENTS

| | | | | |
|---|---|---|---|---|
| 4,100,733 A | | 7/1978 | Striebel et al. | |
| 4,265,085 A | | 5/1981 | Fox et al. | |
| 4,967,561 A | * | 11/1990 | Bruhwiler et al. | 60/737 |
| 4,982,570 A | | 1/1991 | Waslo et al. | |
| 5,094,610 A | * | 3/1992 | Mandai et al. | 431/183 |
| 5,154,059 A | * | 10/1992 | Keller | 60/737 |
| 5,156,002 A | * | 10/1992 | Mowill | 60/746 |
| 5,235,814 A | | 8/1993 | Leonard | |
| 5,237,812 A | | 8/1993 | Mumford | |
| 5,319,936 A | | 6/1994 | Ikeda et al. | |
| 5,400,587 A | | 3/1995 | Keller et al. | |
| 5,491,970 A | | 2/1996 | Davis, Jr. et al. | |
| 5,623,826 A | | 4/1997 | Ohtsuka et al. | |
| 5,722,230 A | | 3/1998 | Cohen et al. | |
| 5,836,164 A | * | 11/1998 | Tsukahara et al. | 60/737 |
| 5,974,781 A | | 11/1999 | Correa et al. | |
| 5,983,643 A | | 11/1999 | Kiesow | |
| 6,038,861 A | | 3/2000 | Amos et al. | |
| 6,082,111 A | | 7/2000 | Stokes | |
| 6,164,055 A | | 12/2000 | Lovett et al. | |
| 6,430,930 B1 | * | 8/2002 | Andersson | 60/725 |

FOREIGN PATENT DOCUMENTS

| | | | |
|---|---|---|---|
| JP | 05-215338 | * | 8/1993 |
| WO | WO009945 | * | 2/2000 |

* cited by examiner

*Primary Examiner*—Ted Kim

(57) ABSTRACT

A gas turbine combustor (10) having a first grouping (64) of pre-mix burners (12, 12', 12") having mixing passages (36) that are geometrically different than the mixing passages (38) of a second grouping (66) of pre-mix burners (14, 14', 14"). The aerodynamic differences created by these geometric differences provide a degree of control over combustion properties of the respective flames (44, 46) produced in a downstream combustion chamber (40) when the two groupings of burners are fueled by separate fuel stages (52, 54). The geometric difference between the fuel passages of the two groupings may be outlet diameter, slope of convergence of the passage diameter, or outlet contour. The fuel injection regions (16, 18) of all of the burners may be identical to reduce cost and inventory complexity. The burners may be arranged in a ring (60) with a center pre-mix burner (68) being identical to burners of either of the groupings.

19 Claims, 1 Drawing Sheet

GAS TURBINE COMBUSTOR HAVING STAGED BURNERS WITH DISSIMILAR MIXING PASSAGE GEOMETRIES

FIELD OF THE INVENTION

This invention relates to the field of gas turbine engines.

BACKGROUND OF THE INVENTION

Gas turbine engines are known to include a compressor for compressing air; a combustor for producing a hot gas by burning fuel in the presence of the compressed air produced by the compressor, and a turbine for expanding the hot gas to extract shaft power. Diffusion flames burning at or near stoichiometric conditions with flame temperatures exceeding 3,000° F. dominate the combustion process in many older gas turbine engines. Such combustion will produce a high level of oxides of nitrogen (NOx). Current emissions regulations have greatly reduced the allowable levels of NOx emissions. Lean premixed combustion has been developed to reduce the peak flame temperatures and to correspondingly reduce the production of NOx in gas turbine engines. In a premixed combustion process, fuel and air are premixed in a premixing section of the combustor. The fuel-air mixture is then introduced into a combustion chamber where it is burned. U.S. Pat. No. 6,082,111 describes a gas turbine engine utilizing a can annular premix combustor design. Multiple fuel nozzles and associated premixers are positioned in a ring to provide a premixed fuel/air mixture to a combustion chamber. A pilot fuel nozzle is located at the center of the ring to provide a flow of pilot fuel to the combustion chamber.

The design of a gas turbine combustor is complicated by the necessity for the gas turbine engine to operate reliably with a low level of emissions at a variety of power levels. High power operation requires greater quantities of fuel making the lean pre-mix combustion principle, and therefore emissions requirements, significantly more difficult. Low power operation conversely challenges operational stability tending to increase the generation of carbon monoxide and unburned hydrocarbons due to incomplete combustion of the fuel. Under all operating conditions, it is important to ensure the stability of the flame to avoid unexpected flameout, damaging levels of acoustic vibration, and damaging flashback of the flame from the combustion chamber into the fuel premix section of the combustor. A relatively rich fuel/air mixture will improve the stability of the combustion process but will have an adverse affect on the level of emissions. A careful balance must be achieved among these various constraints in order to provide a reliable machine capable of satisfying very strict modern emissions regulations.

Dynamics concerns vary among the different types of combustor designs. Gas turbines having an annular combustion chamber include a plurality of burners disposed in one or more concentric rings for providing fuel into a single toroidal annulus. U.S. Pat. No. 5,400,587 describes one such annular combustion chamber design. Annular combustion chamber dynamics are generally dominated by circumferential pressure pulsation modes between the plurality of burners. In contrast, gas turbines having can annular combustion chambers include a plurality of individual can combustors, such as the combustor described in the aforementioned '111 patent, wherein the combustion process in each can is relatively isolated from interaction with the combustion process of adjacent cans. Can annular combustion chamber dynamics are generally dominated by axial pressure pulsation modes within the individual cans.

Staging is the delivery of fuel to the combustion chamber through at least two separately controllable fuel supply systems or stages including separate fuel nozzles or sets of fuel nozzles. It is known in a can annular combustor of the type described in the aforementioned '111 patent to provide fuel to the ring of main fuel burners through two different stages, alternating the stages between adjacent burners around the ring. In this manner, a degree of control is afforded to the operator to affect the combustion conditions by independently varying the amount of fuel supplied to each stage as the power level of the engine is changed. The burners are symmetrically staged around the longitudinal axis of the combustor so that the flame produced by both stages is the same. Improved performance is achieved by increasing the power level of the combustor primarily with one main fuel stage as the second main fuel stage is kept at a reduce fuel flow rate. Once the first stage is at full power, the second main fuel stage is ramped up to full power. The burners of both stages are identical, so the flame conditions in the combustor are the same regardless of which stage is the first stage to be ramped upward.

The demand to decrease exhaust emissions continues, thus it is desired to operate a gas turbine engine with little or no diffusion flame. The control of combustion in a gas turbine engine becomes very challenging without the stabilizing effects of a pilot diffusion flame. Improved techniques for controlling the combustion conditions of a gas turbine engine are needed.

SUMMARY OF THE INVENTION

A combustor for a gas turbine engine is described herein as including: a plurality of main fuel supply pre-mix burners, each burner including a fuel injection region and a mixing region downstream of the fuel injection region; a combustion chamber disposed downstream of the plurality of burners; a first main fuel stage in fluid communication with a first grouping of the burners; a second main fuel stage in fluid communication with a second grouping of the burners; wherein the mixing region of a burner of the first grouping of burners comprises a geometry different than the geometry of the mixing region of a burner of the second grouping of burners so that a property of a flame produced in the combustion chamber by the first grouping of burners is different than a property of a flame produced in the combustion chamber by the second grouping of burners. The outlet end of the mixing region of the burner of the first grouping of burners may be a diameter different than a diameter of an outlet end of the mixing region of the burner of the second grouping of burners, or the outlet end of the mixing region of the burner of the first grouping of burners may have a contour different than a contour of an outlet end of the mixing region of the burner of the second grouping of burners. The mixing region of the burner of the first grouping of burners may have a diameter constant along a longitudinal length; and the mixing region of the burner of the second grouping of burners may have a diameter changing along a longitudinal length. The mixing region of the burner of the first grouping of burners may have a diameter changing along a longitudinal length at a first slope; and the mixing region of the burner of the second grouping of burners may have a diameter changing along a longitudinal length at a second slope. The fuel injection region of the burner of the first grouping of burners may be essentially identical to the fuel injection region of the burner of the second grouping of burners.

A can annular combustor for a gas turbine engine is described herein as including: a first grouping of pre-mix burners alternately interspaced between a second grouping of pre-mix burners to form a ring about a longitudinal axis; a first main fuel stage in fluid communication with the first grouping of pre-mix burners; a second main fuel stage in fluid communication with the second grouping of pre-mix burners; wherein a mixing region of each of the first grouping of pre-mix burners is geometrically different than a mixing region of each of the second grouping of pre-mix burners.

BRIEF DESCRIPTION OF THE DRAWINGS

These and other advantages of the invention will be more apparent from the following description in view of the drawings that show.

DETAILED DESCRIPTION OF THE INVENTION

A degree of control over the combustion process in a gas turbine engine is accomplished by providing fuel to groupings of burners through separately controllable fuel stages. The addition of a fuel stage adds expense for design, manufacturing and maintenance of the additional equipment required. A typical prior art can annular combustor may have a pilot fuel stage for providing fuel to a pilot burner and two main fuel stages for providing fuel to alternate ones of a ring of main burners surrounding the pilot burner. The present invention provides an additional degree of control over the combustion process in such a multi-stage combustor without the need for yet another fuel stage. This is accomplished by providing aerodynamically different burners for each main fuel stage.

Figure 1:
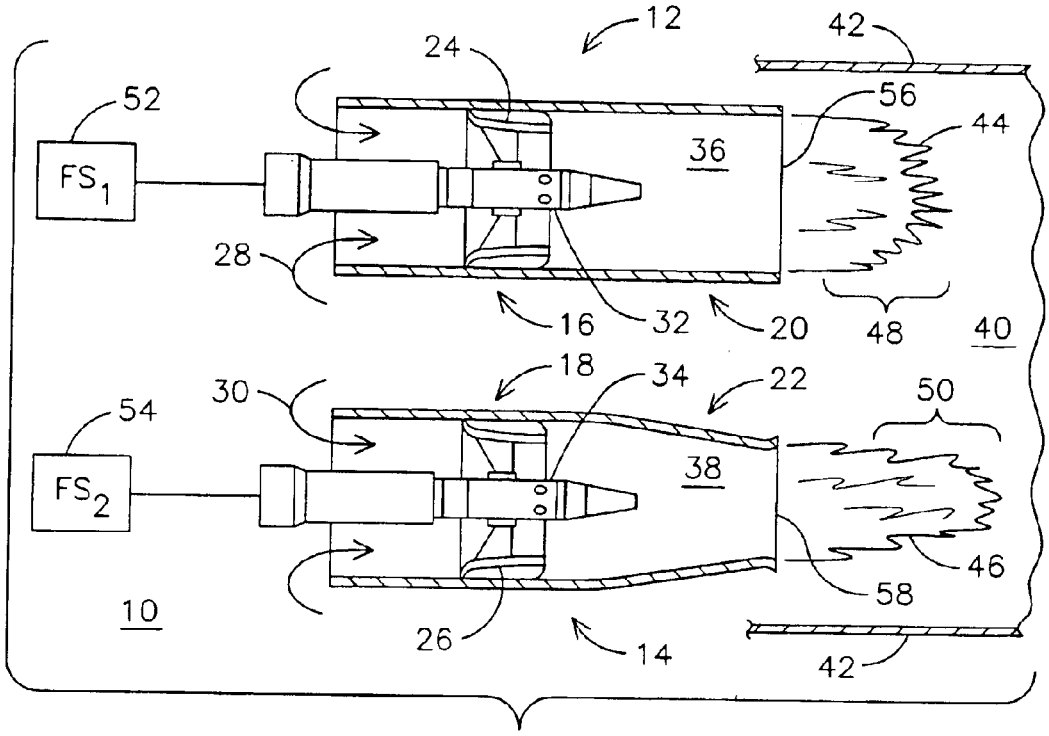
FIG. 1 is a partial cross-sectional view of two burners having identical fuel injection regions and different mixing regions.

FIG. 1 illustrates two pre-mix burners 12, 14 of a combustor 10 having essentially identical fuel injection regions 16, 18 but having different mixing regions 20, 22. The fuel injection regions 16, 18 each include a swirler 24, 26 for imparting a swirl to the compressed combustion air 28, 30 passing through the respective burner 12, 14, and a fuel injector 32, 34 for injecting a flow of fuel into the compressed air 28, 30. One skilled in the art may appreciate that the fuel injection regions 16, 18 may include other designs known in the art, such as a combination swirler/injector, a fuel peg, inclined injectors, etc. Furthermore, the fuel injection regions 16, 18 do not necessarily have to be identical. However, the cost of a burner is dominated by the cost of the fuel injection region components, and there is a financial advantage to keeping the fuel injection regions 16, 18 identical. In addition to the design and manufacturing costs, there is a logistical and cost advantage to maintaining a parts inventory wherein all of the main burners have identical mixing regions.

The mixing regions 20, 22 of burners 12, 14 have respective mixing passages 36, 38 with different geometries, thus providing different mixing parameters to the respective mixing regions 20, 22. The result is that the fuel/air mixture will have different mixing and aerodynamic properties as it exits the respective burners 12, 14 to enter the downstream combustion chamber 40 defined by the combustor liner 42. Thus, the flames 44, 46 produced by the respective burners 12, 14 will have different properties. For example, the active combustion region 48 of a first burner 12 may be shorter in an axial direction along the fluid flow and may be located farther upstream than the active combustion region 50 of a second burner 14. Such differences may be further exploited with the addition of fuel staging. In particular, a first fuel stage 52 may be used to supply fuel to the first burner 12 and a second fuel stage 54 may be used to provide fuel to the second burner 14. The combustion conditions within combustion chamber 40 when the first fuel stage 52 is operated at X % and the second fuel stage is operated at Y % will be different than the combustion conditions within combustion chamber 40 when the first fuel stage 52 is operated at Y % and the second fuel stage is operated at X %. Combustion properties that may be controlled by selecting the split of total fuel flow between the two stages 52, 54 include temperature distribution and dynamic pressure response. This degree of control is not achieved by a prior art combustor using main fuel burners that all have the same mixing region geometry. Furthermore, this degree of control may be achieved while using fuel injection regions 16, 18 that are essentially identical, i.e. they are formed of a plurality of parts that are interchangeable and that are functionally equivalent and that can be identified with the same part numbers for inventory purposes, with only ancillary parts, for example attachment hardware, having differences necessitating different part numbers.

The geometric differences between the mixing region 20 of a first main fuel stage burner 12 and the mixing region 22 of a second main fuel stage burner 14 may take many forms. Mixing passage 36 has a constant diameter along its axial length whereas mixing passage 38 has a diameter that changes (converges) so that the diameters of the respective outlet ends 56, 58 are different. The contour of the outlet ends 56, 58 may also be different. The converging diameter of mixing passage 38 has a slope along its longitudinal length with respect to its longitudinal axis, and that slope may be changed between burners of different stages.

Figure 2:
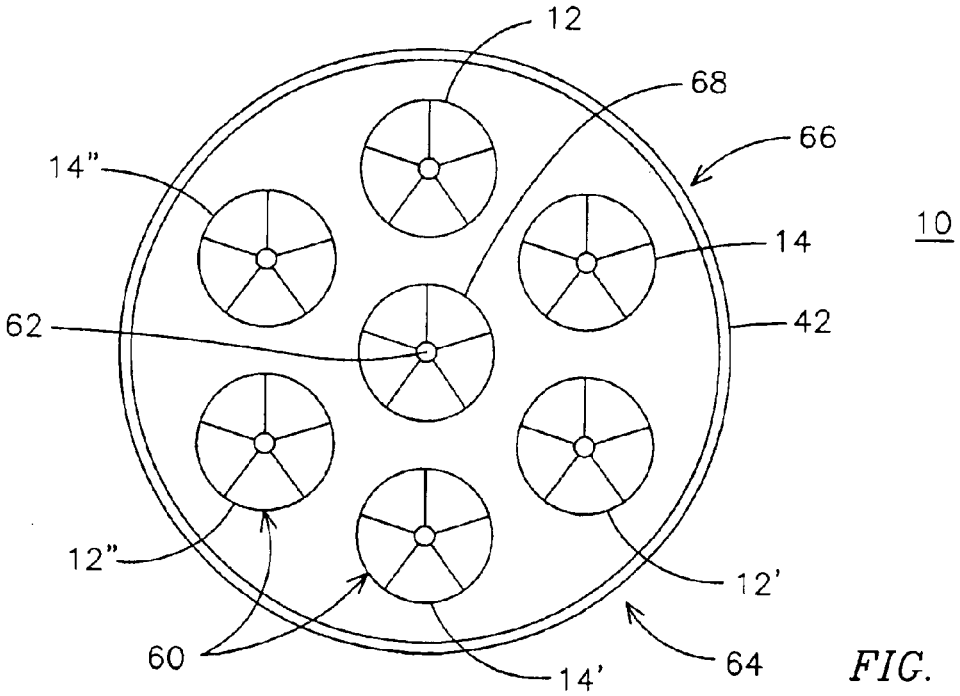
FIG. 2 is a plan view of a section of a combustor having groupings of burners with different mixing passage outlet diameters.

FIG. 2 is a plan view of a section of combustor 10 as it may be viewed looking upstream along a section through combustion chamber 40. Combustor liner 42 has a generally cylindrical shape surrounding a ring 60 of burners disposed about a longitudinal axis 62, with burners 12, 12' and 12" fueled from first fuel stage 52 being interspaced between burners 14, 14' and 14" fueled from second fuel stage 54. Burners 12, 12', 12" form a first grouping 64 of main burners and burners 14, 14', 14" form a second grouping 66 of main burners. Groupings may include one or more burners in various embodiments, and the number of groupings may be two or more in various embodiments. Combustor 10 also includes a center pre-mix burner 68 disposed at the center of the ring 60. Center burner 68 may be fueled by either of the first fuel stage 52 or second fuel stage 54 or it may be in fluid communication with an independent third main fuel stage. The center burner 68 may have a fuel injection region 16 that is identical to that of the burners of the first and/or second groupings 64, 66, and it may have a mixing region 20 that is identical to that of the burners of either the first grouping 64 or the second grouping 66. The center burner 68 may also include a diffusion fuel stage, however, the degree of combustion control provided by the arrangement of combustor 10 may effectively eliminate the need for a diffusion pilot burner depending upon the requirements of the particular application.

While the preferred embodiments of the present invention have been shown and described herein, it will be obvious that such embodiments are provided by way of example only. Numerous variations, changes and substitutions will occur to those of skill in the art without departing from the invention herein. Accordingly, it is intended that the invention be limited only by the spirit and scope of the appended claims.

I claim as my invention:

1. A combustor for a gas turbine engine, the combustor comprising:

a plurality of main fuel supply pre-mix burners, each burner comprising a fuel injection region and a mixing region downstream of the fuel injection region;

a single combustion chamber region disposed downstream of the plurality of burners for receiving and combusting fuel/air mixtures received from all of the burners with no flow restriction there between;

a first main fuel stage in fluid communication with a first grouping of the burners, each burner of the first grouping comprising a mixing region having a first geometry;

a second main fuel stage in fluid communication with a second grouping of the burners, each burner of the second grouping comprising a mixing region having a second geometry aerodynamically different than the first geometry;

wherein the first main fuel stage and the second main fuel stage cooperate with the respective first geometry and second geometry to provide a supplemental degree of control over dynamic pressure response in the combustion chamber when a split of a fixed total fuel flow between the first and second stages is varied so that first combustion conditions exist in the combustion chamber with a first split of the total fuel flow between the first and second stages, and second combustion conditions different from the first combustion conditions exist in the combustion chamber with a second split of the total fuel flow between the first and second stapes.

2. The combustor of claim 1, further comprising an outlet end of the mixing region of the burner of the first grouping of burners comprising a diameter different than a diameter of an outlet end of the mixing region of the burner of the second grouping of burners.

3. The combustor of claim 1, further comprising an outlet end of the mixing region of the burner of the first grouping of burners comprising a contour different than a contour of an outlet end of the mixing region of the burner of the second grouping of burners.

4. The combustor of claim 1, further comprising:

the mixing region of the burner of the first grouping of burners having a diameter constant along a longitudinal length; and the mixing region of the burner of the second grouping of burners having a diameter changing along a longitudinal length.

5. The combustor of claim 1, further comprising:

the mixing region of the burner of the first grouping of burners having a diameter changing along a longitudinal length at a first slope; and the mixing region of the burner of the second grouping of burners having a diameter changing along a longitudinal length at a second slope.

6. The combustor of claim 1, further comprising the fuel injection region of the burner of the first grouping of burners being essentially identical to the fuel injection region of the burner of the second grouping of burners.

7. The combustor of claim 1, further comprising:

the plurality of burners being arranged to form a ring about the longitudinal axis; and alternate ones of the burners about the ring comprising the respective first and second groupings.

8. The combustor of claim 7, further comprising a pre-mix burner disposed at a center of the ring and in fluid communication with a third fuel stage.

9. The combustor of claim 8, wherein the center burner comprises a mixing region geometry essentially identical to the mixing region geometry of the burner of the first grouping of burners.

10. The combustor of claim 9, wherein the center burner comprises a fuel injection region essentially identical to a fuel injection region of the burner of the first grouping of burners.

11. A can annular combustor for a gas turbine engine comprising:

a first grouping of pre-mix burners each comprising a first mixing region geometry alternately interspaced between a second grouping of pre-mix burners each comprising a second mixing region geometry aerodynamically different than the first mixing region geometry to form a ring about a longitudinal axis, the first and second grouping of burners discharging respective fuel/air mixtures into a common downstream combustion chamber region;

a first main fuel stage in fluid communication with the first grouping of pre-mix burners;

a second main fuel stage in fluid communication with the second grouping of pre-mix burners;

wherein the first and second main fuel stages cooperate with the first and second mixing region geometries to provide a supplemental degree of control over combustion dynamics in the combustion chamber region when a split of a fixed total fuel flow between the first and second main fuel stages is varied, so that first combustion conditions exist in the combustion chamber region with a first split of the total fuel flow between the first and second main fuel stages, and second combustion conditions different from the first combustion conditions exist in the combustion chamber region with a second split of the total fuel flow between the first and second main fuel stages.

12. The can annular combustor of claim 11, further comprising an outlet end of the mixing region of each of the burners of the first grouping of pre-mix burners comprising a diameter different than a diameter of an outlet end of the mixing region of each of the burners of the second grouping of pre-mix burners.

13. The can annular combustor of claim 11, further comprising an outlet end of the mixing region of each of the burners of the first grouping of pre-mix burners comprising a contour different than a contour of an outlet end of the mixing region of each of the burners of the second grouping of pre-mix burners.

14. The can annular combustor of claim 11, further comprising:

the mixing region of each of the burners of the first grouping of pre-mix burners having a diameter constant along a longitudinal length; and the mixing region of each of the burners of the second grouping of pre-mix burners having a diameter changing along a longitudinal length.

15. The combustor of claim 11, further comprising:

the mixing region of each of the burners of the first grouping of pre-mix burners having a diameter changing along a longitudinal length at a first slope; and the mixing region of each of the burners of the second grouping of pre-mix burners having a diameter changing along a longitudinal length at a second slope.

16. The can annular combustor of claim 11, further comprising a fuel injection region of each of the first grouping of pre-mix burners being essentially identical to a fuel injection region of each of the second grouping of pre-mix burners.

17. The can annular combustor of claim 11, further comprising a center pre-mix burner disposed at a center of the ring and in fluid communication with a third main fuel stage.

18. The combustor of claim 17, wherein the center pre-mix burner comprises a mixing region geometry essentially identical to the mixing region geometry of each of the burners of the first grouping of pre-mix burners.

19. The combustor of claim 17, wherein the center pre-mix burner comprises a fuel injection region essentially identical to a fuel injection region of each of the burners of at least one of the group of the first grouping of pre-mix burners and the second grouping of pre-mix burners.

* * * * *